US009299552B2

(12) United States Patent
Yorisaki

(10) Patent No.: US 9,299,552 B2
(45) Date of Patent: Mar. 29, 2016

(54) SPUTTER NEUTRAL PARTICLE MASS SPECTROMETRY APPARATUS

(71) Applicant: KABUSHIKI KAISHA TOSHIBA, Minato-ku (JP)

(72) Inventor: Toma Yorisaki, Tokyo (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 14/640,766

(22) Filed: Mar. 6, 2015

(65) Prior Publication Data

US 2015/0270112 A1 Sep. 24, 2015

(30) Foreign Application Priority Data

Mar. 18, 2014 (JP) ..... 2014-054601

(51) Int. Cl.

| | |
|---|---|
| ***H01J 49/26*** | (2006.01) |
| ***H01J 49/16*** | (2006.01) |
| ***H01J 49/04*** | (2006.01) |
| ***H01J 49/06*** | (2006.01) |

(52) U.S. Cl.

CPC ..... *H01J 49/161* (2013.01); *H01J 49/0409* (2013.01); *H01J 49/0468* (2013.01); *H01J 49/06* (2013.01)

(58) Field of Classification Search

USPC ..... 250/281, 282, 288, 440.11, 441.11, 250/442.11, 443.1

See application file for complete search history.

(56) References Cited

U.S. PATENT DOCUMENTS

| | | | | |
|---|---|---|---|---|
| 2007/0075240 | A1* | 4/2007 | Hieke | 250/282 |
| 2013/0320204 | A1* | 12/2013 | Komatsu et al. | 250/282 |
| 2014/0363678 | A1* | 12/2014 | Kirkpatrick et al. | 428/408 |

FOREIGN PATENT DOCUMENTS

| | | | |
|---|---|---|---|
| JP | 05-307906 | A | 11/1993 |
| JP | 07-161331 | A | 6/1995 |
| JP | 10-132789 | A | 5/1998 |

* cited by examiner

*Primary Examiner* — Nicole Ippolitio

(74) *Attorney, Agent, or Firm* — Oblon, McClelland, Maier & Neustadt, L.L.P

(57) ABSTRACT

A sputter neutral particle mass spectrometry apparatus includes a sample table holding a sample which is a mass spectrometry target, and comprising a temperature control mechanism for the sample, an ion beam irradiation device which irradiates an ion beam on the sample to generate neutral particles, a laser irradiation device which irradiates the neutral particles with a laser to obtain photoexcited ions, a mass spectrometer which draws in the drawn out photoexcited ions and performs mass analysis, a driving system mirror which is provided retractably on a laser light path between the laser irradiation device and the sample table, and reflects the laser when positioned within the laser light path, and, a profiler which is arranged in a reflective direction of the driving system mirror and detects a feature of the laser.

3 Claims, 2 Drawing Sheets

SPUTTER NEUTRAL PARTICLE MASS SPECTROMETRY APPARATUS

CROSS-REFERENCE TO RELATED APPLICATION

This application is based upon and claims the benefit of priority from the prior Japanese Patent Application No. 2014-054601, filed Mar. 18, 2014, the entire contents of which are incorporated herein by reference.

FIELD

The embodiment of the present invention relates to a sputter neutral particle mass spectrometry apparatus.

BACKGROUND

In recent years, a sputter neutral particle mass spectrometry apparatus using a focused ion beam device and a laser oscillation device has been developed. In this apparatus, an ion beam generated in a column inside an ion beam device is irradiated on a particular region of a sample to perform sputtering. A laser is irradiated on neutral particles which have been sputtered in the above manner, and neutral particles generated according to ion beam scanning are mass separated/detected by a mass spectrometer to obtain a scanned image (For example, see Patent documents 1 and 2).

In laser SNMS measurements provided with a focused ion beam device, a beam diameter of a primary ion beam is as small as a few tens of nanometers (nm), and therefore is susceptible to contamination by water, oxygen, carbon hydride, etc. distributed on the surface of a measurement sample when compared to a secondary ion mass spectrometry apparatus. Therefore, even within a same sample, the quantification results of a detected element would differ depending on where the primary ion beam is irradiated. Therefore, it would be difficult to maintain reproducibility with high accuracy.

Since the primary ion beam diameter is small in the above-mentioned laser SNMS measurements, the ionization rate of the neutral particles in post-ionization is easily influenced by where the laser is irradiated. Since the ionization cross-section would differ depending on the element, it is necessary to accurately ascertain and control the position of the laser condensing spot when carrying out measurement. However, since the position of the laser condensing spot is controlled by the signal amount of the ion detected by the mass spectrometer, it has been impossible to separate factors such as primary ion beam irradiation, laser irradiation, and drawing-in timing conditions of a secondary ion, and to unify laser irradiation conditions between the measurement samples. Therefore, it has been difficult to maintain the quantitativeness of measurements.

In recent years, in measurements using a time of fly secondary ion mass spectrometer (TOF-SIMS) in which focused ion beams (FIB) are the primary ion beams, and a laser SNMS device, a sputter neutral particle mass spectrometry apparatus which maintains quantitativeness of measurements by unifying laser irradiation conditions between measurement samples, resulting in high sensitivity and high reproductivity, has been required.

DETAILED DESCRIPTION

A sputter neutral particle mass spectrometry apparatus according to one embodiment includes a sample table holding a sample which is a mass spectrometry target, and comprising a temperature control mechanism for the sample, an ion beam which is irradiated on the sample held by the sample table to generate neutral particles, a laser irradiation device which irradiates the neutral particles with a laser to obtain photoexcited ions, a draw-out electrode which draws out the photoexcited ions, a mass spectrometer which draws in the drawn out photoexcited ions and performs mass analysis, a driving system mirror which is provided retractably on a laser light path between the laser irradiation device and the sample table, and reflects the laser when positioned within the laser light path, and, a profiler which is arranged in a reflective direction of the driving system mirror and detects a feature of the laser.

Figure 1:
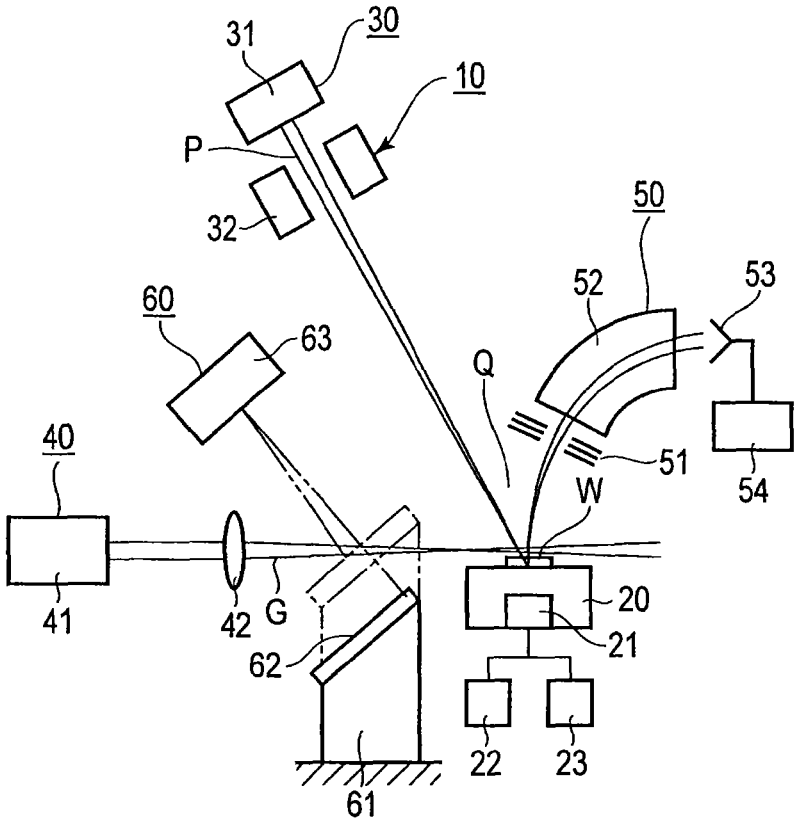
FIG. 1 is a schematic diagram showing a sputter neutral particle mass spectrometry apparatus according to a first embodiment.
Figure 2:
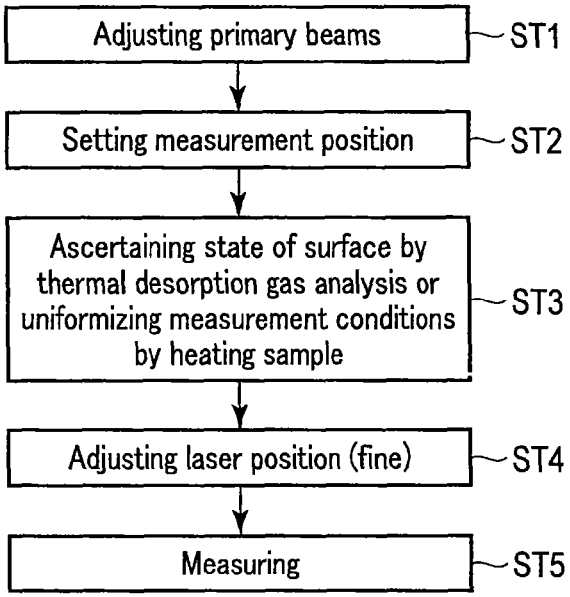
FIG. 2 is a diagram showing preparation procedures before measurement at the sputter neutral particle mass spectrometry apparatus.
Figure 3:
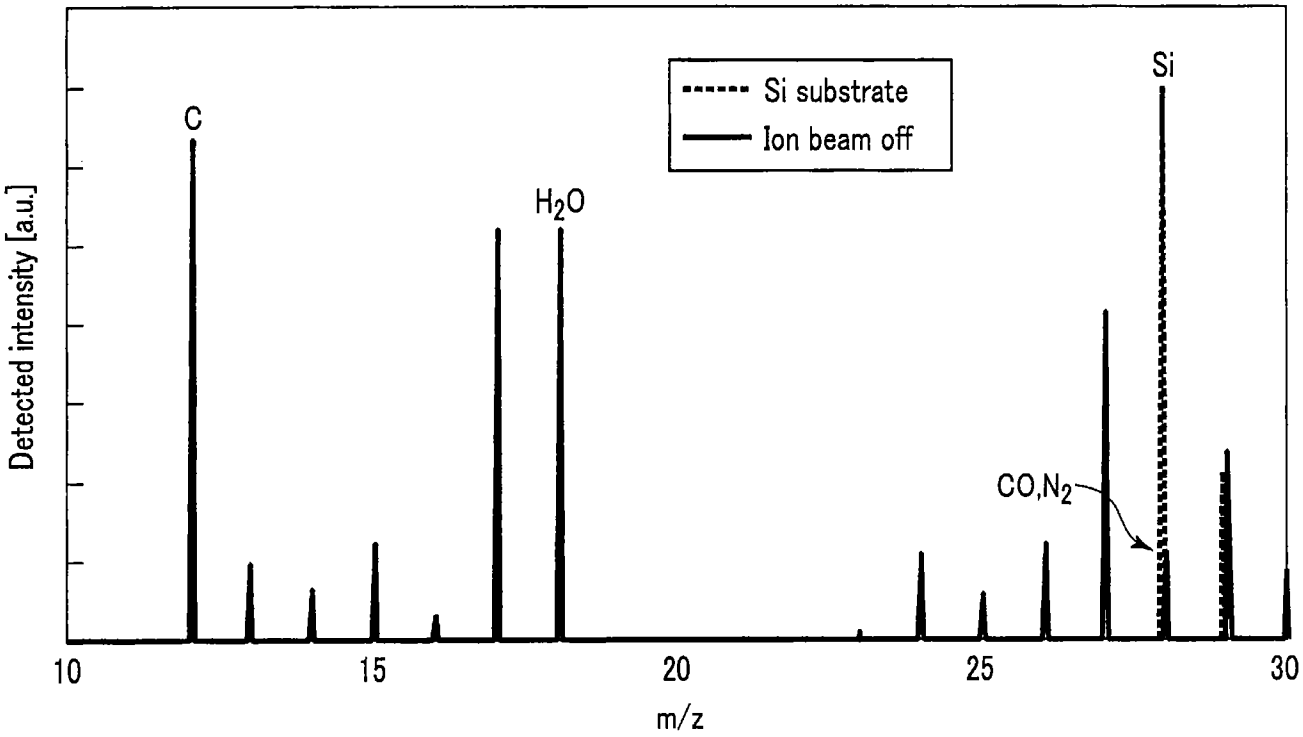
FIG. 3 is a diagram showing the result of performing laser SNMS measurement on an Si substrate in the sputter neutral particle mass spectrometry apparatus.

FIG. 1 is a schematic diagram showing a sputter neutral particle mass spectrometry apparatus 10 according to a first embodiment, FIG. 2 is a diagram showing preparation procedures before measurement at the sputter neutral particle mass spectrometry apparatus 10, and FIG. 3 is a diagram showing the result of performing laser SNMS measurement on an Si substrate in the sputter neutral particle mass spectrometry apparatus 10.

The sputter neutral particle mass spectrometry apparatus 10 comprises a sample table 20 which is accommodated inside a vacuum chamber etc. and holds a sample W which is an analysis object, an ion beam irradiation device 30 which is arranged above the sample table 20 and irradiates an ion beam P on the sample W to generate neutral particles, a laser irradiation device 40 which irradiates a laser G to a space Q directly above the sample table 20, a mass spectrometry apparatus 50 which is arranged near the space Q and draws in the neutral particles to perform mass analysis, and a profile device 60 provided above the sample table 20.

A temperature control mechanism 21 is attached to the sample table 20 to adjust the temperature of the sample W. The temperature control mechanism 21 is connected to a heating heater 22 and a cooling reservoir 23. The temperature is controlled by supplying power to the heating heater 22 when heating, and supplying a cooling liquid (for example, liquid nitrogen) to the cooling reservoir 23 when cooling.

The ion beam irradiation device 30 comprises an ion beam generating device 31 which generates primary ion beams P and an electrostatic lens 32 which converges the primary ion beams P.

The laser irradiation device 40 comprises a pulse laser generator 41, and a lens 42 which condenses a laser G generated from this pulse laser generator 41. The neutral particles which are irradiated with the laser G are ionized and become photoexcited ions.

The mass spectrometry apparatus 50 comprises a draw-out electrode 51 to which voltage is applied and draws out photoexcited ions, a mass separator 52 which utilizes a magnetic field or electric field to perform mass separation for the drawn out photoexcited ions, an ion detector 53 which detects the mass separated photoexcited ions and electrically pulses them, and a pulse counter 54 which counts electric pulses.

The profile device 60 comprises a jig 61 which is removably provided on a laser light path between the lens 42 and the sample table 20, a driving system mirror 62 which is provided on this jig 61 and reflects the laser G received from the lens 42 side when positioned on the laser light path, and a profiler 63 which comprises a CCD etc. which measures the reflected light of the laser G from the driving system mirror 62. The distance between the driving system mirror 62 and the profiler 63 is set to be equal to the distance from the driving system mirror 62 to the center of the sample table 20.

The sputter neutral particle mass spectrometry apparatus 10 configured in the above manner performs adjustment operation and mass analysis. As shown in FIG. 2, the adjustment operation includes adjusting the primary ion beams P prior to measurement (ST1), and setting the measurement position (ST2). Subsequently, the heating heater 22 of the sample table 20 is operated to ascertain the state of the surface of the sample W and to perform cleansing. The sample surface admolecule peeled off by heating the measurement portion by the heater 22 is ionized by the laser G, then mass analyzed to ascertain the state of the sample W surface. FIG. 3 is a diagram showing the result of performing laser SNMS measurement on an Si substrate in the sputter neutral particle mass spectrometry apparatus 10. The measurement result using a usual measuring method is expressed as Si, and the measurement performed by stopping the ion beams in this measuring method is expressed as ion beam off. In the state of ion beam off, $H_2O$, C, CO, $N_2$, etc., which are residual gases within the vacuum chamber, were detected. Subsequently, by controlling the temperature of the sample W, the measurement condition is uniformized (ST3). The sample W is heated using a heating heater 22 in the manner mentioned above. However, to lower the temperature, a cooling liquid is introduced to the cooling reservoir 23.

Subsequently, the driving system mirror 62 is adjusted using the jig 61, the laser G is reflected, and the profiler 63 is installed to ascertain the position of the condensing spot of the laser G and the intensity distribution of the laser G three dimensionally on a coordinate. This will allow to set the condensing spot of the laser G with respect to the irradiation position of the primary ion beams P with high accuracy (ST4). The above operation will improve the accuracy of mass analysis and reproducibility. When the adjustment operation is completed, measurement is performed (ST5).

In other words, the primary ion beams P are generated from the ion beam generating device 31. After the primary ion beams P are converged using the electrostatic lens 32, they are collided with the surface of the sample W. This collision will cause the neutral particles to discharge from the surface of the sample W and float in the space directly above the sample table 20. Meanwhile, the laser G generated from the pulse laser generator 41 is condensed by the lens 42 and irradiated on the neutral particles. The neutral particles are ionized near the focal point of the laser G and become photoexcited ions. The photoexcited ions are drawn out by the draw-out electrode 51 on which voltage is applied, and are mass separated by the mass separator 52. Furthermore, the photoexcited ions are detected by the ion detector 53 and electrically pulsed. This electric pulse is counted by the pulse counter 54 in order to analyze the sample W.

After the analysis of one to a plurality of samples W are completed, in order to maintain quantification of the measurement, thereby enhancing high sensitivity and reproducibility, the above-mentioned procedure of ST4 is performed, and the laser irradiation device 40 is adjusted.

In the sputter neutral particle mass spectrometry apparatus 10 according to the present embodiment configured in the above manner, the profile device 60 is used to set the condensing spot of the laser G with high accuracy, in order to maintain quantitativeness of the measurement, thereby enabling high sensitivity and high reproducibility.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sputter neutral particle mass spectrometry apparatus comprising:

a sample table holding a sample which is a mass spectrometry target, and comprising a temperature control mechanism for the sample;

an ion beam irradiation device which irradiates an ion beam on the sample held by the sample table to generate neutral particles;

a laser irradiation device which irradiates the neutral particles with a laser to obtain photoexcited ions;

a draw-out electrode which draws out the photoexcited ions;

a mass spectrometer which draws in the drawn out photoexcited ions and performs mass analysis;

a driving system mirror which is provided retractably on a laser light path between the laser irradiation device and the sample table, and reflects the laser when positioned within the laser light path; and a profiler which is arranged in a reflective direction of the driving system mirror and detects a feature of the laser.

2. The sputter neutral particle mass spectrometry apparatus according to claim 1, wherein the temperature control mechanism comprises a heating heater and a cooling reservoir, and controls temperature by supplying power to the heating heater, or supplying a cooling liquid to the cooling reservoir.

3. The sputter neutral particle mass spectrometry apparatus according to claim 1, wherein a distance between the driving system mirror and the profiler is equal to a distance from the driving system mirror to a center of the sample table.

* * * * *